US010112219B1

(12) United States Patent
McManaman

(10) Patent No.: US 10,112,219 B1
(45) Date of Patent: Oct. 30, 2018

(54) ROTATIONAL BRUSH FOR CLEANING LAPS OF SIDING

(71) Applicant: Tim McManaman, Danvers, IL (US)

(72) Inventor: Tim McManaman, Danvers, IL (US)

( * ) Notice: Subject to any disclaimer, the term of this patent is extended or adjusted under 35 U.S.C. 154(b) by 0 days.

(21) Appl. No.: 15/490,864

(22) Filed: Apr. 18, 2017

(51) Int. Cl.

| | |
|---|---|
| ***A47L 13/16*** | (2006.01) |
| ***B08B 1/04*** | (2006.01) |
| ***A46B 5/00*** | (2006.01) |
| ***B08B 1/00*** | (2006.01) |
| ***A46B 9/02*** | (2006.01) |
| ***A46B 13/02*** | (2006.01) |

(52) U.S. Cl.
CPC ..... *B08B 1/04* (2013.01); *A46B 5/0012* (2013.01); *A46B 9/028* (2013.01); *A46B 13/02* (2013.01); *B08B 1/002* (2013.01); *A46B 2200/3073* (2013.01)

(58) Field of Classification Search
CPC .. A46B 9/00; A46B 9/02; A46B 9/028; A46B 2200/30; A46B 2200/3073; Y10S 15/05; A47L 13/10; A47L 13/44
See application file for complete search history.

(56) References Cited

U.S. PATENT DOCUMENTS

| | | | | |
|---|---|---|---|---|
| 4,962,607 | A * | 10/1990 | Baldwin | F41A 29/02 15/104.165 |
| 5,488,747 | A * | 2/1996 | Woodhouse | A46B 5/06 15/179 |
| 8,024,995 | B2 * | 9/2011 | Dayton | B25F 3/00 173/216 |
| 9,057,575 | B2 * | 6/2015 | Shipman | F41A 29/02 |
| 9,456,682 | B2 * | 10/2016 | Taylor | A46B 13/02 |
| 9,693,568 | B2 * | 7/2017 | Pulliam | A22C 21/022 |
| 2006/0099025 | A1 * | 5/2006 | Hann | B05C 17/0212 401/197 |

* cited by examiner

*Primary Examiner* — Shay Karls

(57) ABSTRACT

A rotational brush for cleaning laps of siding featuring a set of rotational tiered brush elements complementary to the profile of laps of siding. The tiered brush elements attach to an elongated axle connectable to a motor drive imparting a rotational force to the brush, which when positioned in contact with laps of siding, further imparts a scrubbing action for the rotational brush to remove debris from laps of siding.

10 Claims, 5 Drawing Sheets

ROTATIONAL BRUSH FOR CLEANING LAPS OF SIDING

CROSS-REFERENCE TO RELATED APPLICATIONS

Not applicable.

BACKGROUND OF THE INVENTION

Field of the Invention

The present invention relates generally to rotational driven brushes, and more particularly to a rotational brush for cleaning laps of siding.

Description of Related Art

Laps of siding involve long, even, horizontal rows of siding, referred to as laps, which are thicker on the bottom than they are on the top, whereas a horizontal row of siding overlaps the row of siding directly below, creating a waterfall effect providing a watertight seal for the exterior side walls of a housing structure, keeping elements out.

Mold, mildew, and algae particularly grow on areas of laps of siding which have no or limited direct sunlight. Dust, dirt, and pollen also attach to laps of siding, collectively creating debris which provides a soiled and undesirable appearance for a housing structure.

Prior to the present invention, one of the most common methods of cleaning laps of siding was with the use of a scrubbing brush with a handle. This method requires significant manual labor, being time consuming and strenuous. Another method to clean laps of siding was with the use of a power washer. Laps of siding are designed with a waterfall effect and therefore repel water as it falls from the sky. Laps of siding are not designed to receive water from the horizontal or bottom sides of the laps of siding. Such receipt of water from the horizontal or bottom sides can allow water to penetrate the laps of siding and create trapped water between the laps of siding and the understructure. This trapping of water can further damage the housing structure. Additionally, power washing laps of siding does not provide a scrubbing action and may not thoroughly remove debris.

BRIEF SUMMARY OF THE INVENTION

In view of the disadvantages inherent in the known types of cleaning brushes and methods of cleaning laps of siding, an object of the present invention is to provide a new rotational brush for cleaning laps of siding.

It is another object of the present invention to provide a new rotational brush for cleaning laps of siding which is conveniently connected and disconnected to a motor drive, such a power drill, to provide a rotational force.

It is a further object of the present invention to provide a new rotational brush for cleaning laps of siding which is of a length to reach various heights of laps of siding common among housing structures. It is appreciated that a plurality of extension apparatuses can be adapted to provide a means for the rotational brush to be extended to various heights.

An even further object of the present invention is to provide a new rotational brush for cleaning laps of siding wherein a plurality of laps of siding can be cleaned simultaneously.

These and other objects of this invention shall become more apparent from the ensuing descriptions of the invention.

Accordingly, in general terms, a rotational brush for cleaning laps of siding is disclosed comprising a rigid, conductive or nonconductive, elongated axle with opposing first and second ends. A novel set of tiered brush elements, which are adapted to complement the profile of laps of siding, are attached to the first end of the elongated axle, radiating outwardly and extending longitudinally towards the second end of the elongated axle. Preferably, the set of tiered brush elements span two to four laps of siding wherein two to four laps of siding can be simultaneously cleaned. Longitudinally opposite the set of tiered brush elements, the second end of the elongated axle connects and disconnects to a motor drive. When activated, the motor drive imparts a rotational force such that the elongated axle rotates the tiered brush elements, further imparting a rotational scrubbing action to remove debris when the tiered brush elements are in contact with laps of siding.

BRIEF DESCRIPTION OF THE SEVERAL VIEWS OF THE DRAWINGS

The novel features of the rotational brush for cleaning laps of siding are set forth in the claims. The invention itself, as well as its features will be best understood by the reference to the detailed drawings and accompanying description. It is appreciated that these drawings show preferred embodiments of the invention, however, should not be considered limiting, wherein:

DETAILED DESCRIPTION OF THE INVENTION

Figure 1:
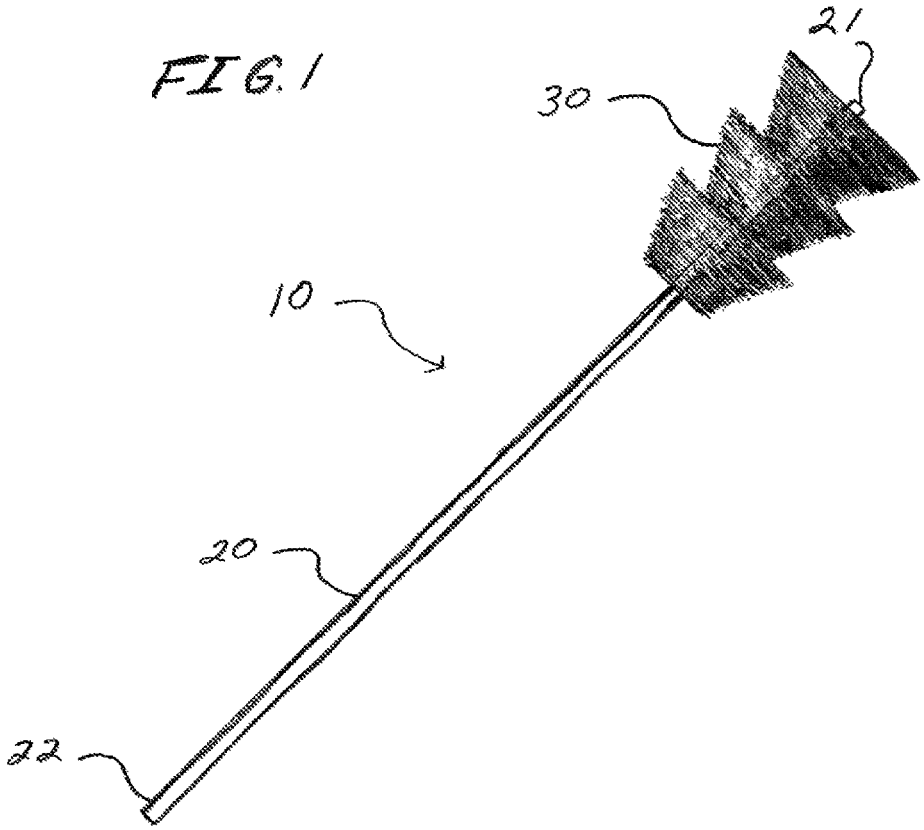
FIG. 1 shows a side view of the rotational brush for cleaning laps of siding according to a preferred embodiment of this invention.

With reference to FIG. 1, a new rotational brush for cleaning laps of siding, designated by the numeral 10 is described. The invention comprises an elongated axle 20, having a first end 21 and second end 22. A plurality of tiered brush elements 30 are attached to the elongated axle 20. It is appreciated that a plurality of methods exist to attach tiered brush elements 30 to the axle 20. The tiered brush elements 30 attach to the elongated axle 20, radiating outwardly and extending in a longitudinal direction towards the second end 22 of the elongated axle 20. The tiered brush elements 30 are adapted to be complementary to the profile of a plurality of laps of siding, and may be comprised of a plurality of synthetic and natural materials such as nylon, polypropylene or horse hair.

Figure 2:
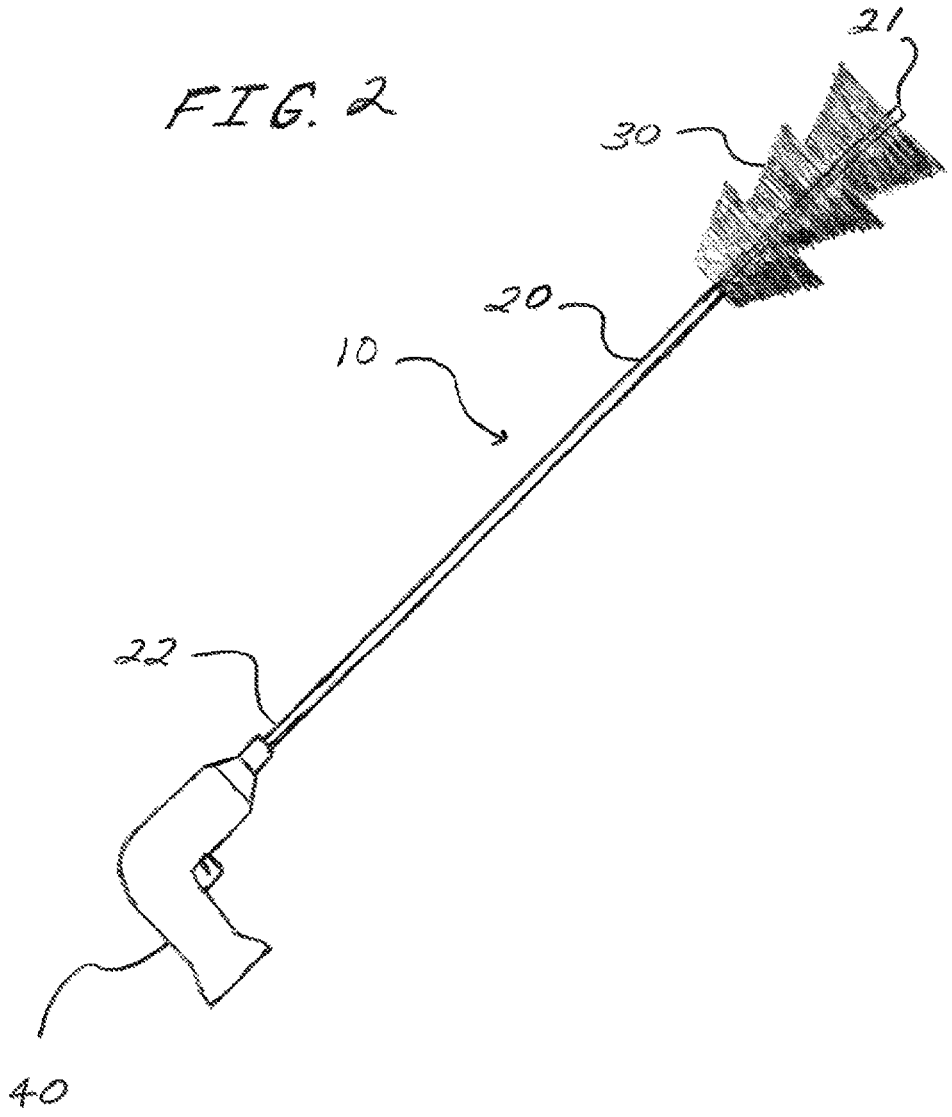
FIG. 2 shows a side view of the rotational brush for cleaning laps of siding according to a preferred embodiment of this invention, connected to a motor drive such as a conventional drill.

Referring to FIG. 2, the brush 10 is attached to a motor drive such as a power drill 40 imparting a rotational force to the brush 10.

Figure 3:
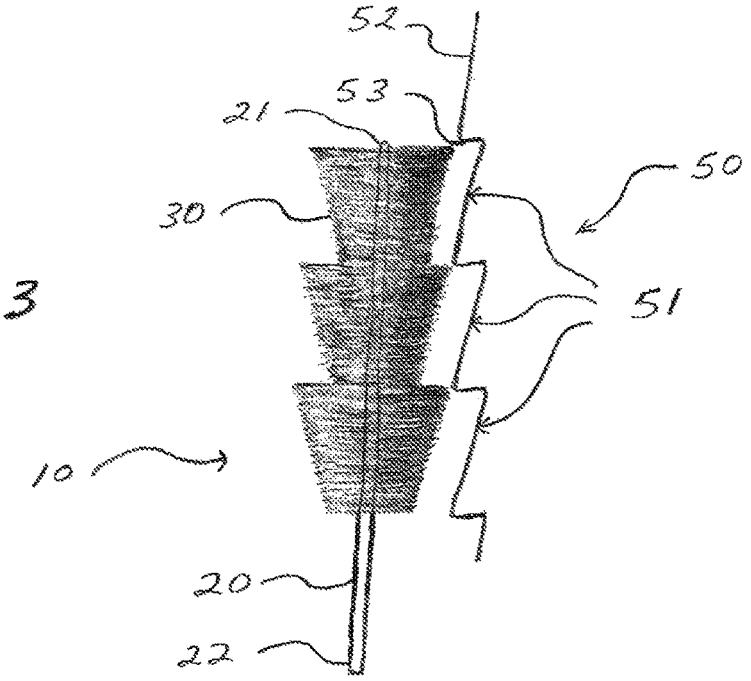
FIG. 3 is a side view of the tiered brush elements of the rotational brush of FIG. 1 showing the tiered brush elements complementary to one variation of laps of siding.

Referring to FIG. 3 the brush 10 is shown whereas the tiered brush elements 30 are adapted to be complementary to the profile of laps of siding 50. It is appreciated that there are a plurality of profiles of laps of siding and the tiered brush elements 30 may be adapted to complement other profiles of laps of siding. Generally, laps of siding 50 are comprised of overlapping horizontal rows 51 having side surfaces 52 and under surfaces 53. Generally, the rows 51 are extended lengths and the side surfaces 52 are about 3 to 6 inches in width and the under surfaces 53 are about ¼ to 1 inch in thickness. The tiered brush elements 30, for the particular profile of laps of siding 50 shown in FIG. 3 are adapted conically wherein the upper end of the tiered brush elements 30 is of a larger diameter tapering to a smaller diameter and repeating conically to complement three rows 51 of laps of siding 50. The tiered brush elements 30 are adapted such that when coming in contact with laps of siding 50 the tiered brush elements 30 evenly contact the side surfaces 52 of the laps of siding 50.

Figure 4:
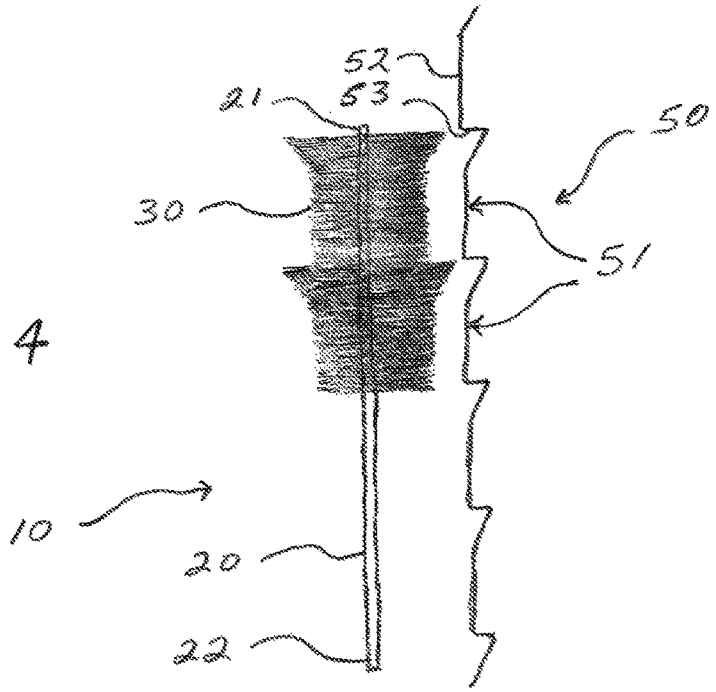
FIG. 4 is a side view of the tiered brush elements of the rotational brush of FIG. 1 showing the tiered brush elements complementary to a second variation of laps of siding.

Referring to FIG. 4, another embodiment of the brush 10 is shown, whereas the tiered brush elements 30 are adapted to another profile of laps of siding 50, complementing two rows 51 of laps of siding 50.

Figure 5:
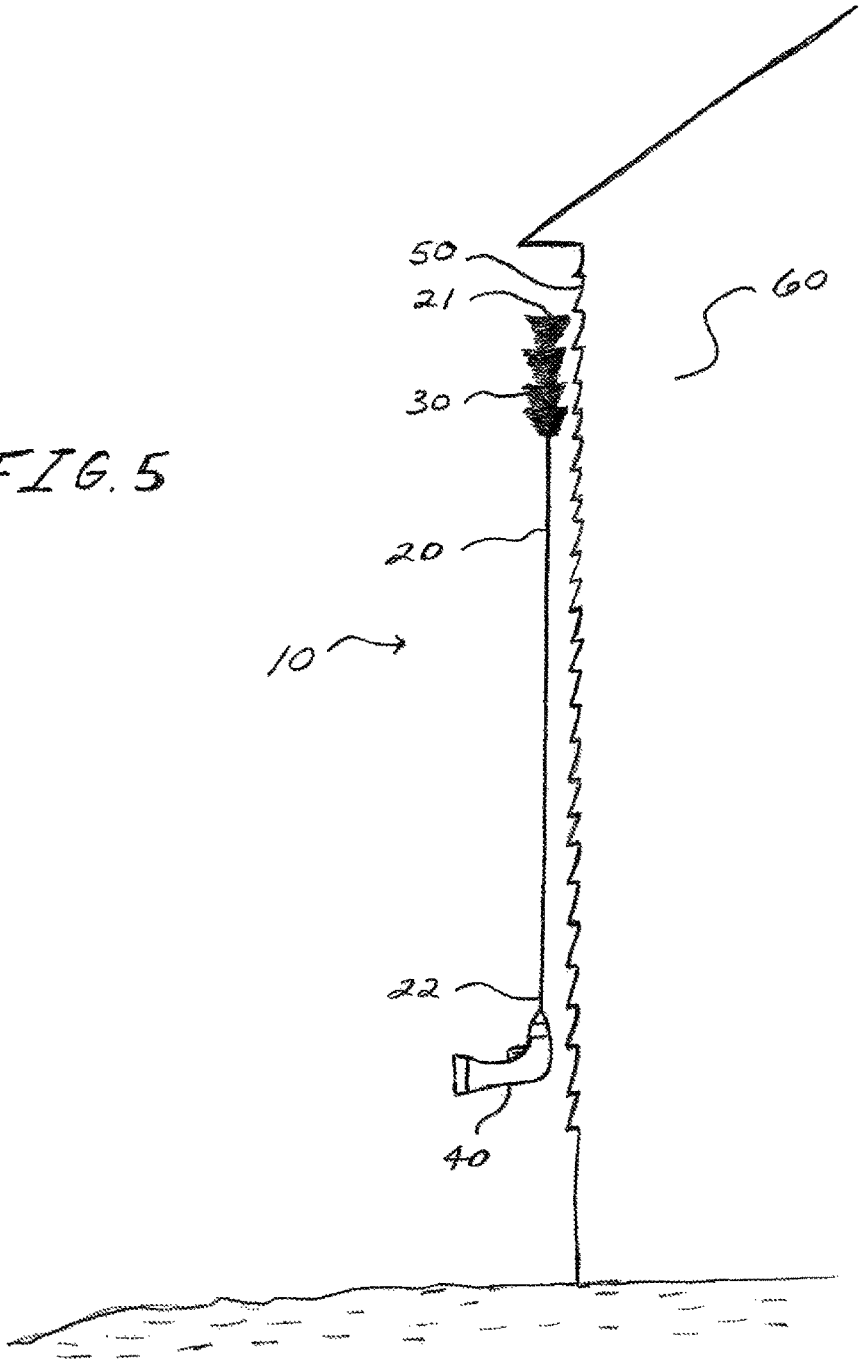
FIG. 5 is a side view of the rotational brush for cleaning laps of siding with an elongated axle of a length to reach an extended height of laps of siding.

Referring to FIG. 5, the brush 10 is shown with an elongated axle 20 of a length to reach laps of siding 50 at an extended height. It is appreciated that there are a plurality of lengths of which elongated axle 20 may be comprised based upon the height of the housing structure 60.

Further referencing FIG. 5, in use, the brush 10 comprising an elongated axle 20, having a first end 21 and a second end 22, with a plurality of tiered brush elements 30, adapted to be complementary to the profile of laps of siding 50, attached to the elongated axle 20, and a motor drive such as a power drill 40 applying a rotational force to the brush 10, and brush 10 coming in contact with laps of siding 50, a rotational scrubbing action is imparted upon the laps of siding 50, removing debris. To assist in use, a light application of water or cleaning fluid may be applied to the laps of siding 50 prior to using the brush 10 for cleaning, and a light application of water may be applied to the laps of siding 50 after using the brush 10 for rinsing debris from the laps of siding 50.

Figure 6:
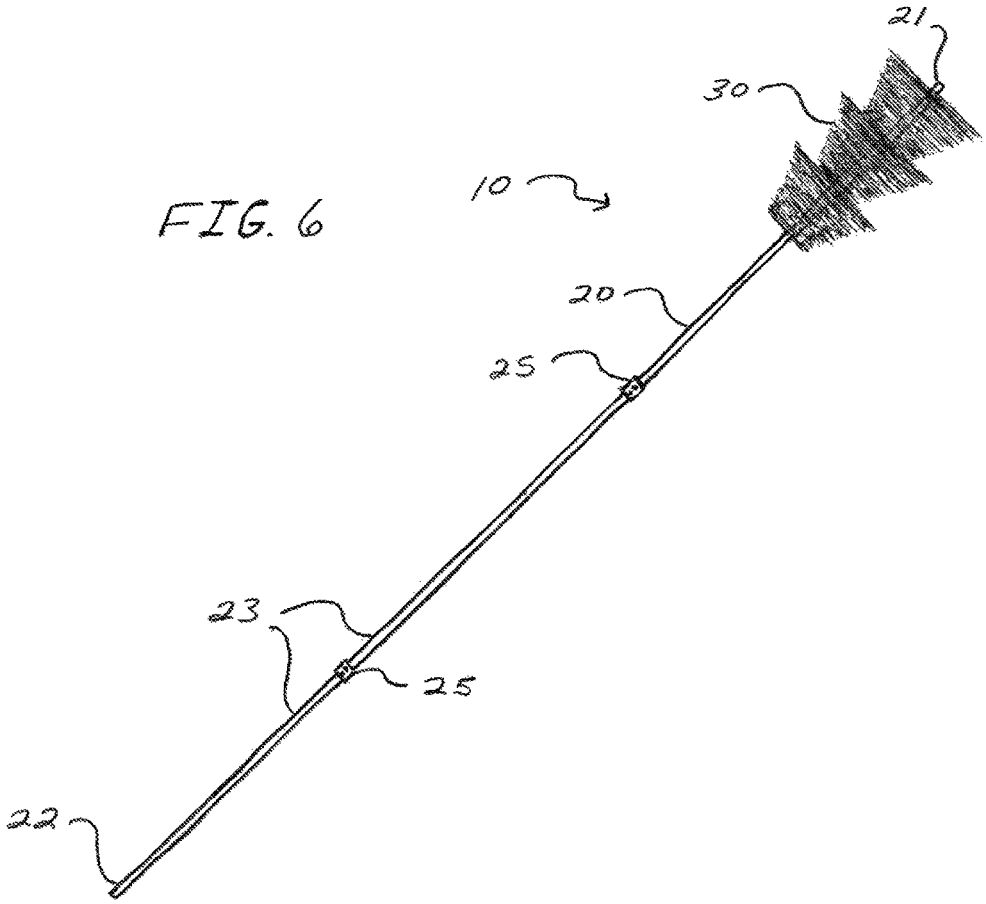
FIG. 6 is another embodiment of the rotational brush for cleaning laps of siding with a sectional axle of a length to reach an extended height of laps of siding; and, FIG. 7 is an exploded view of the sectional connection of the sectional axle.

Referring to FIG. 6, an additional embodiment is shown wherein the brush 10 is attached to a plurality of connectable and dis-connectable extension sections 23 attached to the elongated axle 20 with the extension connector 25.

Figure 7:
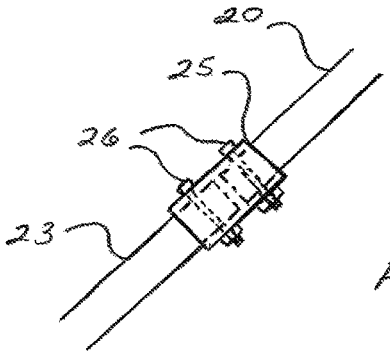

Referring now to FIG. 7, the elongated axle 20 attaches to the extension connector 25 with a conventional fastener 26. The extension section 23 attaches to the extension connector 25 with a conventional fastener 26.

The invention claimed is:

1. A rotational brush for cleaning laps of siding comprising:

an elongated axle having a first end and a second end, a cleaning brush with repeating tiers of brush elements wherein the repeating tiers of brush elements are of the same longitudinal length and profile shape, and are complimentary to the profile of a plurality of laps of siding, the laps of siding formed of overlapping horizontal rows having side and under surfaces, wherein the repeating tiers of brush elements attach to the first end of the elongated axle, radiating outwardly and extending longitudinally towards the second end of the elongated axle, and a connection between the second end of the elongated axle and a motor drive, causing a rotational force, such that the elongated axle rotates the attached repeating tiers of brush elements, imparting a rotational scrubbing action to remove debris, when the repeating tiers of brush elements are in contact with laps of siding.

2. The rotational brush of claim 1 wherein the elongated axle is comprised of a rigid conductive material.

3. The rotational brush of claim 1 wherein the elongated axle is comprised of rigid non-conductive material.

4. The rotational brush of claim 1 wherein the elongated axle is of a length to reach a plurality of heights for removing debris from laps of siding.

5. The rotational brush of claim 1 wherein the elongated axle is attached to a plurality of connectable and disconnectable extension sections.

6. The rotational brush of claim 1 wherein the elongated axle is attached to a telescoping extension section.

7. The rotational brush of claim 1 wherein the repeating tiers of brush elements vary in height to complement the profile of a plurality of laps of siding.

8. The rotational brush of claim 1 wherein the repeating tiers of brush elements are made of a plurality of synthetic materials such as nylon or polypropylene.

9. The rotational brush of claim 1 wherein the connection is such that the second end of the elongated axle is able to be connected and disconnected to a motor drive.

10. A method for using the rotational brush of claim 1 for cleaning laps of siding, said method comprising the steps of:

a. connecting the second end of the elongated axle to a motor drive;

b. aligning the cleaning brush with repeating tiers of brush elements which are complementary to the profile of laps of siding, with laps of siding;

c. activating a motor drive applying a rotational force to the cleaning brush with repeating tiers of brush elements;

d. positioning the rotational brush such that the cleaning brush with repeating tiers of brush elements are in contact with laps of siding; and e. traversing the rotational brush horizontally while in contact with laps of siding, imparting a rotational scrubbing action upon laps of siding, removing debris.

* * * * *